US011849836B2

(12) United States Patent
Wolf

(10) Patent No.: US 11,849,836 B2
(45) Date of Patent: Dec. 26, 2023

(54) BRUSH HEAD FOR A BODY CARE DEVICE AND BODY CARE DEVICE COMPRISING THE BRUSH HEAD

(71) Applicant: KONINKLIJKE PHILIPS N.V., Eindhoven (NL)

(72) Inventor: Harold Wolf, Oranje (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 527 days.

(21) Appl. No.: 17/250,170

(22) PCT Filed: Jun. 24, 2019

(86) PCT No.: PCT/EP2019/066582
§ 371 (c)(1),
(2) Date: Dec. 8, 2020

(87) PCT Pub. No.: WO2020/002183
PCT Pub. Date: Jan. 2, 2020

(65) Prior Publication Data

US 2021/0244170 A1 Aug. 12, 2021

(30) Foreign Application Priority Data

Jun. 29, 2018 (EP) ..... 18180700

(51) Int. Cl.
*A46B 7/02* (2006.01)
*A46B 5/00* (2006.01)
(Continued)

(52) U.S. Cl.
CPC ..... *A46B 7/023* (2013.01); *A46B 5/0012* (2013.01); *A46B 5/0091* (2013.01); *A46B 7/06* (2013.01);
(Continued)

(58) Field of Classification Search
CPC ..... A46B 7/023; A46B 5/0012; A46B 5/0091; A46B 7/06; A46B 9/028; A46B 13/003; A47K 7/04; A47K 7/028
See application file for complete search history.

(56) References Cited

U.S. PATENT DOCUMENTS

2012/0272982 A1 11/2012 Telwar
2013/0060176 A1* 3/2013 Nichols ..... A46B 13/008 601/137
(Continued)

FOREIGN PATENT DOCUMENTS

CN 104367248 2/2015
CN 105996869 10/2016
(Continued)

OTHER PUBLICATIONS

International Search Report and Written Opinion dated Sep. 4, 2019 for International Application No. PCT/EP2019/066582 Filed Jun. 24, 2019.

*Primary Examiner* — Shay Karls

(57) ABSTRACT

The present invention relates to a brush head (10, 10*a*, 10*b*, 10*c*) for use with a body care device (100), comprising a plurality of bristles (22, 22*a*-22*e*), a carrier (16) for fixedly carrying the plurality of bristles (22, 22*a*-22*e*), and connection means for connecting the carrier (16) to a housing (50) of the body care device (100) defining a first axis (14), so that, when the brush head is connected to the housing (50), the carrier (16) is rotatable about the first axis (14) and pivotable about a second axis (20) perpendicular to the first axis (14) with respect to the housing (50), wherein the carrier (16) comprises a plurality of carrier parts (17), each fixedly carrying a corresponding one of a plurality of bristle groups (26, 28, 30), and wherein at least one of the plurality
(Continued)

of carrier parts (17) comprises a shaft defining a third axis (40, 42, 44) about which the corresponding bristle group (26, 28, 30) is rotatable.

15 Claims, 5 Drawing Sheets

(51) Int. Cl.

| | |
|---|---|
| ***A46B 7/06*** | (2006.01) |
| ***A46B 9/02*** | (2006.01) |
| ***A46B 13/00*** | (2006.01) |
| ***A47K 7/04*** | (2006.01) |

(52) U.S. Cl.
CPC ..... *A46B 9/028* (2013.01); *A46B 13/003* (2013.01); *A47K 7/04* (2013.01); *A46B 2200/102* (2013.01); *A46B 2200/1006* (2013.01)

(56) References Cited

U.S. PATENT DOCUMENTS

| | | | |
|---|---|---|---|
| 2015/0164733 | A1 | 6/2015 | Thiebaut |
| 2017/0188758 | A1 | 7/2017 | Clos |

FOREIGN PATENT DOCUMENTS

| | | |
|---|---|---|
| KR | 101425988 | 8/2014 |
| WO | 200679817 | 8/2006 |
| WO | 2016/162275 | 10/2016 |
| WO | 2017/102897 | 6/2017 |

* cited by examiner

BRUSH HEAD FOR A BODY CARE DEVICE AND BODY CARE DEVICE COMPRISING THE BRUSH HEAD

CROSS REFERENCE TO RELATED APPLICATIONS

This application is the U.S. National Phase application under 35 U.S.C. § 371 of International Application No. PCT/EP2019/066582 filed Jun. 24, 2019, which claims the benefit of European Patent Application Number 18180700.9 filed Jun. 29, 2018. These applications are hereby incorporated by reference herein.

FIELD OF THE INVENTION

The present invention relates to a brush head for a body care device and the body care device comprising the brush head. It finds application in body care treatments such as cleaning and cleansing of skins of a body part, e.g. facial skins, both for adults and infants.

BACKGROUND OF THE INVENTION

Brush heads and body care devices comprising a brush head for treating the skin are known in the art. For instance, WO 2017/102897 A1 discloses a body care device for treating the skin, wherein the body care device comprises a housing and a skin treatment head associated with the housing, wherein the housing further comprises an actuator configured to rotate the skin treatment head about an axis. The skin treatment head a plurality of bristles.

During use, the brush head is driven by an actuator integrated into the housing of the body care device so that the brush head rotates about the axis. Under a certain pressure to the skin surface, the rotation of the brush head is able to clean and cleanse the skin.

Using the brush heads known from the art, it is, however, difficult to adjust the pressure forces of the bristles in order to achieve a proper force distribution of the different bristles to take into account that different areas of the skin surface have different sensibility and need to be treated with different pressure forces.

CN 105996869 A discloses a multi-angle facial brush with a 3D brush head and a motion driving method of the multi-angle facial brush. The multi-angle facial brush comprises a shell, the brush head and a brush head driving structure. The brush head comprises a bristle base, a connecting part used for receiving driving and an elastic part installed on the connecting part. The brush head driving structure comprises a motor, an eccentric wheel, a linkage part and a connecting shaft used for being connected with the brush head, and an eccentric column of the eccentric wheel stretches upwards into a sliding groove of the linkage part. Under the action of rotation of the motor, the eccentric column acts on the sliding groove of the linkage part, and the brush head conducts plane-direction reciprocating motion and 3D face-attaching elastic deformation motion along with the linkage part and can scrub and clean the surface of the face in a reciprocating mode and be attached to the curved surface of the face to conduct 3D face-attaching deformation.

Further prior art can be found in CN 104367248 A, WO 2016/162275 A1 and US 2017/188758 A1.

SUMMARY OF THE INVENTION

It is an object of the present invention to provide a brush head and a body care device comprising such a brush head which enable a proper force distribution by the bristles onto the skin surface.

In a first aspect of the present invention a brush head for use with a body care device, comprising a plurality of bristles, a carrier for fixedly carrying the plurality of bristles, and connection means for connecting the carrier to a housing of the body care device defining a first axis, so that, when the brush head is connected to the housing, the carrier is rotatable about the first axis and pivotable about a second axis perpendicular to the first axis with respect to the housing, wherein the carrier comprises a plurality of carrier parts, each fixedly carrying a corresponding one of a plurality of bristle groups, and wherein at least one of the plurality of carrier parts comprises a shaft defining a third axis about which the corresponding bristle group is rotatable.

In a further aspect of the present invention a body care device is presented that comprises a brush head as disclosed herein and a housing to which the brush head is connected, the housing being configured to accommodate an actuator for driving the brush head to rotate with respect to the housing.

Preferred embodiments of the invention are defined in the dependent claims. It shall be understood that the claimed body care device has similar and/or identical preferred embodiments as the claimed brush head and as defined in the dependent claims.

Using bristles, the skin surface can be cleaned and cleansed properly without hurting the skin. The bristles may be made of the same or different materials, in particular natural or synthetic materials. Preferably, the bristles are flexible so that they can be bended when pressed against the skin and the pressure force exceeds a predefined threshold.

In addition, using the connection means, the carrier is connectable to the housing of the body care device. This means that the brush head including the connection means may be attached to the housing of the body care device with help of the connection means for body care treatments. After the treatments, the brush head may be detached from the housing of the body care device, so that the brush head may be cleaned, repaired and/or replaced.

Further, the connection means are formed so that the carrier is, when connected to the housing of the body care device, rotatable about the first axis relative to the housing. The first axis is therefore a rotation axis defined by the housing of the body care device. The first axis extends preferably in the direction of elongation of the housing. Alternatively, if the housing has several sections along its elongation each extending in a different direction, the first axis extends preferably in the direction of elongation of one of the sections of the housing.

By bringing the brush head into contact with a skin surface of a body part (e.g. facial skin), the bristles exert a certain pressure force onto the skin surface. Due to the rotation of the bristles about the axis of the body care device, the bristles are moved relative to the skin surface, thereby providing the skin with a massage which relaxes the skin muscles. Further, the relative movement between the bristles and the skin surface is also able to exfoliate the skin to remove waste objects such as dust particles and dead skin fragments from the skin surface. This achieves a proper cleaning and cleansing effect.

According to the present invention, the connection means are further formed so that the carrier is, when connected to the housing of the body care device, also pivotable about the second axis. The second axis is perpendicular to the first axis. In this way, the bristles are pivotable with respect to the housing. This means that the bristles are not only rotatable about the first axis (i.e. the main axis or actuator axis of the body care device), but also pivotable about an axis that is perpendicular to the first axis with respect to the housing. This yields in an additional degree of freedom which is advantageous for adjusting the distribution of the pressure force of the bristles applied to the skin surface during use of the body care device. For instance, thanks to the pivotability of the carrier with respect to the housing, the user holding the body care device may tilt the housing while not affecting the contact between the bristles and the skin surface.

The carrier comprises a plurality of carrier parts, each carrying a corresponding one of a plurality of bristle groups formed by the plurality of bristles. In a preferable embodiment, each of the plurality of bristle groups contains at least two bristles. The carrier parts may comprise each a shaft. The division of the bristles into bristle groups enables to spatially distribute the bristles so as to achieve a homogeneous distribution of the pressure force when applying the body care device to the skin of a body part.

At least one of the plurality of carrier parts comprises a shaft defining a third axis about which the bristle group carried by the at least one carrier part is rotatable. During rotation of the brush head about the first axis (main axis), the bristles in contact with the skin surface experience a certain degree of friction by the skin surface. Using a shaft rotatable about the third axis, the bristles will be rotated due to the friction of the skin surface. This enables a more smooth contact to the skin surface which is important especially for sensitive skin parts. Preferably, the shaft and/or the bristles are driven to rotate about the third axis so that the smooth contact with the skin surface is more easily established. Further, the third axis is preferably perpendicular to the second axis, but deviations from the perpendicular arrangement are possible.

Preferably, the bristles are divided into three bristle groups each carried by a corresponding carrier part. The carrier parts (e.g. shafts) extend each along a direction which forms an axis with respect to which the bristles of the respective carrier part are essentially symmetrically arranged. Further preferably, the three axes are rotated relative to each other with respect to the first axis so that the rotation angle between two adjacent axes is approximately 120°.

In another preferable embodiment, the connection means comprise a supporting frame for connecting the carrier to the housing of the body care device. This enables easier integration of the brush head to the body care device.

The supporting frame may take the form of a circular, triangular or quadratic plate to receive a portion of the carrier. Additionally or alternatively, the supporting frame may have a cylindrical side wall surrounding a bottom plate, wherein the surface of the bottom plate is adapted to be received by an interface element of the housing of the body care device (e.g. one or more warpings are formed).

The supporting frame may be detachably attached to the housing of the body care device or configured as an integrated part of the housing. Preferably, the supporting frame may be driven (e.g. by an actuator of the housing) to rotate about the first axis with respect to the housing. In this case, the carrier may be stationary to the supporting frame regarding rotation about the first axis so that a rotation of the supporting frame automatically brings the carrier into rotation about the first axis. This enables an easy mechanism for rotating the bristles about the first axis.

Alternatively, the supporting frame may be stationary with respect to the housing while allowing the carrier to rotate with respect to the supporting frame about the first axis. For instance, this may be realized using a screw drivable by an actuator of the housing, wherein the screw extends along the first axis and engages into inner windings of the portion of the carrier received by the supporting frame.

In still a further preferable embodiment, the carrier is pivotable about the second axis with respect to the supporting frame. In this way, the carrier is pivotable with respect to a part of the brush head itself (i.e. locally). Advantageously, this facilitates the production of the brush head since the production steps for providing the pivotability can be carried out locally at the brush head.

In still a further preferable embodiment, at least one of the plurality of carrier parts is connected to the supporting frame in a central region of the supporting frame, preferably using a spherical joint. In this way, the pivotability of the at least one carrier part, preferably all carrier parts, is effectively realized.

The central region is a region in the vicinity of the first axis. If a joint (e.g. spherical joint) is used, the central region is the region between the geographical center, through which the first axis extends, and the (spherical) joint. The bristles may be arranged along a radial direction with respect to the central region. At least one carrier part may be configured to extend diagonally through the central region. Alternatively, at least one carrier part may extend semi-diagonally, i.e. starting from the central region and ending at an outer border. The term "radial" is understood broadly within the scope of the present invention so that it not only refers to a circular brush head or circular supporting frame but may refer to a brush head and/or supporting frame having a triangular, quadratic, hexagonal, octahedral cross-section seen from the top to the bottom (i.e. along the first axis).

A spherical joint has the advantage that both the rotation about the first axis (i.e. main axis) and the pivoting about the second axis perpendicular to the first axis can be realized yielding a compact and cost-efficient brush head.

In still a further preferable embodiment, elastic means are provided so that at least one of the plurality of carrier parts is elastically pivotable with respect to the supporting frame. The at least one carrier part, preferably all carrier parts, is/are elastically pivotable with respect to the supporting frame. Due to the elastic force of the elastic means, the carrier part/parts which is/are pivoted when being pressed (e.g. against the skin surface during use of the body care device) can return from the pressed state (i.e. the state in which an external pressing force towards the skin surface is applied to the brush head, in particular the carrier part) to the unpressed state (i.e. the state in which no external pressing force is applied to the brush head). This further improves the distribution of the pressure force onto the skin surface and enables better control of the exfoliation of the skin. As elastic means, a spring (e.g. a longitudinal spring or a spiral spring) or other elastic materials may be used. Further preferably, the carrier parts extend in a horizontal direction perpendicular to the first axis in the unpressed state.

In still a further preferable embodiment, the elastic means comprise a longitudinal spring arranged to be radially distant from the central region. This enables an easy and cost-efficient carrier which is elastically pivotable with respect to the supporting frame. The longitudinal spring may be arranged to be guided along a guiding element of the supporting frame such as a guiding shaft which extends from an inner surface (e.g. top inner side or bottom inner side) of the supporting frame in the longitudinal direction). The longitudinal spring may be pretensioned (e.g. by a predefined amount of compression/extension) so that even without external pressing force the carrier part(s) is/are pressed against a top inner side of the brush head when the spring is a compression spring, or against a bottom inner side of the brush head when the spring is an extension spring.

Preferably, the plurality of bristles of the at least one bristle group are preferably arranged radially inwardly from the longitudinal spring, further preferably between the joint (e.g. spherical joint) and the longitudinal spring. This enables to avoid collisions between the bristles and the spring.

In still a further preferable embodiment, the elastic means comprise a spiral spring with a spirally formed winding about the second axis. This enables a carrier that is elastically pivotable with respect to the supporting frame while having a compact design.

In still a further preferable embodiment, the bristles of at least one bristle group form two or more subgroups each containing at least one bristle, wherein the bristles of different subgroups have different lengths. The bristles of the at least one bristle group, preferably all bristle groups, are hence divided into subgroups based on their length. In each subgroup, the at least one, preferably plurality of bristles extend from the carrier part, e.g. shaft.

In still a further preferable embodiment, the two or more subgroups are spatially separated from each other along a radial direction with respect to the first axis. In each subgroup, there may be a plurality of sections of bristles distributed about the third axis, each section of bristles being oriented under the same rotation angle with respect to the third axis. Advantageously, during rotation of the shaft about the third axis, the contact between the bristles and the skin surface is less interrupted by always having at least one section of bristles in contact with the skin surface.

In still a further preferable embodiment, at least two of the plurality of bristles differ in length. Preferably, the length of the bristles of the at least one bristle group increases with a radial distance of the respective bristle from a central region of the brush head. A firtree-like bristle group is formed which has a smaller width in the central region of the brush head and a larger width at the outer border of the brush head. This further improves the distribution of the pressure forces of the bristles onto the skin surface. For the case that the shaft extends in perpendicular direction with respect to the first axis when no external force is applied to press the bristles, the radially outer bristles are first brought into contact to the skin surface when applying the brush head to the skin. Preferably, the radially outer bristles are pressed against while the elastic means are contracted. With further increased pressing force which acts against the elastic force of the elastic means (e.g. spring), the shaft is tilted about the second axis so that the end of the bristles of the at least one bristle group, preferably the at least one subgroup, facing the skin are brought to the same height as measured from the shaft.

In still a further preferable embodiment, the brush head further comprises a cover attached to a top side of the carrier, the cover comprising at least one opening, wherein the plurality of bristles are preferably configured to protrude the at least one opening, further preferably a top surface plane of the cover, when no external force is applied to press the bristles towards a bottom side of the carrier. This achieves that the contact between the brush head and the skin surface is well defined and better controlled, so that the skin treatment using the brush head is more effective.

In still a further preferable embodiment, the at least one opening has a width that increases from a central region towards an outer border of the cover. The at least one, preferably all openings have a form which corresponds to the firtree-like form of the bristle groups, so that the contact between the bristles and the skin surface is ensured while maintaining a well-defined contact between the brush head overall and the skin surface during use. Preferably, the number of the openings on the cover corresponds to the number of the bristle groups. Further preferably, the cover is formed as a circular plate, which may have a circumferential wall for preventing mechanical parts within the brush head from damages.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
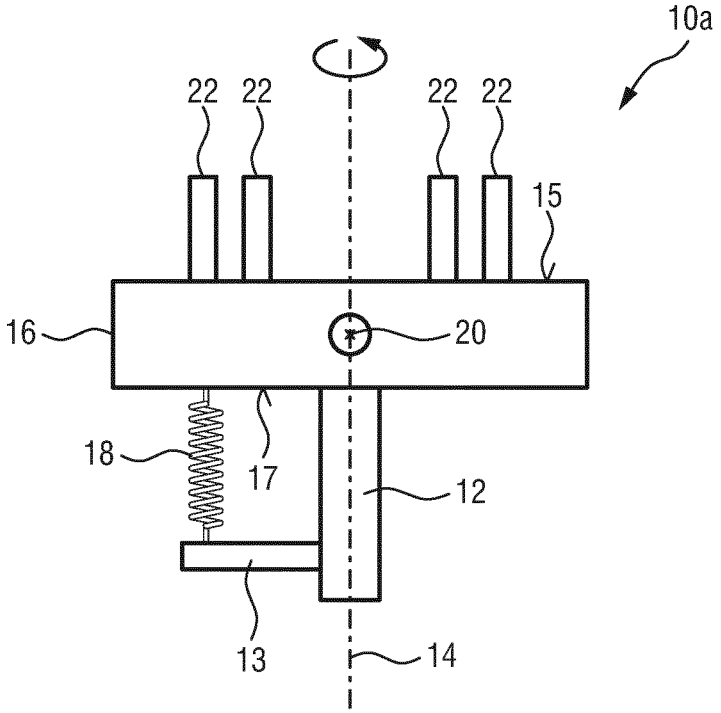
FIG. 1 shows schematically a brush head according to a first embodiment.

FIG. 1 shows schematically a brush head 10*a* according to a first embodiment. The brush head 10*a* is configured for use in a body care device (not shown in FIG. 1), e.g. a device for treatment of the skin of a body part or a plurality of body parts. The brush head 10*a* is connected to a housing (not shown in FIG. 1) of the body care device e.g. via a supporting frame 12. The housing of the body care device defines a first axis 14, preferably a longitudinal axis, i.e. in a direction in which the housing or at least a part of it is elongated. The first axis 14 therefore also defines a rotation center of the brush head.

The brush head 10*a* comprises a carrier 16 that is rotatable about a first axis 14 with respect to the housing when the brush head 10*a* is connected to the housing. The carrier 16 may take the form of a plate, e.g. a circular plate. Alternatively, the carrier 16 may be configured as a shaft.

The brush head 10*a* further comprises a plurality of bristles 22 that are fixedly carried by the carrier 16, e.g. on a top side 15 of the carrier 16. The bristles 22 are made of the same or different materials, in particular natural or synthetic materials. Preferably, the bristles 22 are flexible so that they can be bended when the brush head is pressed against the skin and the pressure force exceeds a predefined threshold.

The supporting frame 12 is preferably a part of the brush head 10*a*. The supporting frame 12 may be rotatable about the first axis 14 with respect to the housing after the brush head is connected to the housing. When the supporting frame 12 is driven (e.g. by an actuator of the housing) to rotate about the first axis 14, the supporting frame 12 preferably drives the carrier 16 so that the latter also rotates about the first axis with respect to the housing. This may be realized using a screw-thread-connection between the supporting frame 12 and the carrier 16 which provides a fix attachment after fastening the supporting frame 12 and the carrier 16 with respect to each other. Alternatively, the carrier 16 may be rotatable about the first axis 14 with respect to the supporting frame 12 which is preferably stationary relative to the housing after being connected to the housing of the body care device. This may be realized by a hinge or a ball-and-socket joint which provides a semi-fix attachment between the supporting frame 12 and the carrier 16 allowing a rotation about the first axis 14 (i.e. in the planar direction) while maintaining a fix connection along the first axis 14 (i.e. in the longitudinal direction).

Further, the carrier 16 is also pivotable about a second axis 20 perpendicular to the first axis 14 with respect to the housing, preferably with respect to the supporting frame 12. The first axis 14 is understood as a longitudinal or main axis of the brush head 10*a*, wherein the second axis 20 is understood as a planar or additional axis. This enables tilting of the carrier 16 and therefore also tilting of the bristles 22 "out of plane". This may be realized by a hinge or a ball-and-socket joint.

As exemplarily shown in FIG. 1, the carrier 16 is connected to the supporting frame 12 further by elastic means, e.g. a longitudinal spring 18. The longitudinal spring 18 may be a compression spring or an extension spring. Further, the longitudinal spring 18 may be pretensioned by a predetermined amount of compression/extension. Preferably, the longitudinal spring 18 is configured such that, when no external force is applied to pivot the carrier 16 about the second axis 20 with respect to the supporting frame 12, the carrier 16 having the form of a plate or shaft is oriented in the planar direction, i.e. perpendicular to the first axis 14. The longitudinal spring 18 is preferably connected with one end being attached to a bottom side 17 of the carrier 16 and the other end being attached to the supporting frame 12, e.g. to a side element 13 of the supporting frame 12 so that the longitudinal spring 18 is oriented essentially parallel to the first axis 14.

When the carrier 16 is pivoted about the second axis 20, the bristles are tilted along with the carrier 16. The tilt angle is determined by the amount of contraction of the longitudinal spring 18. In particular, the maximum tilt angle is determined by the maximum amount of compression or extension of the spring 18, depending on the direction of tilting (i.e. clockwise so that the longitudinal spring 18 is extended, or anti-clockwise so that the longitudinal spring 18 is compressed as seen from FIG. 1).

In FIG. 1, four bristles 22 are exemplarily shown as being arranged on both sides of the rotation center of the brush head 10*a* (two on each side). However, this is not limiting for the present invention. Alternatively, the carrier 16 may be a shaft which extends from the rotation center towards a circumferential end (i.e. border region). A number of bristles 22 different from four may be arranged on the carrier 16.

Figure 2:
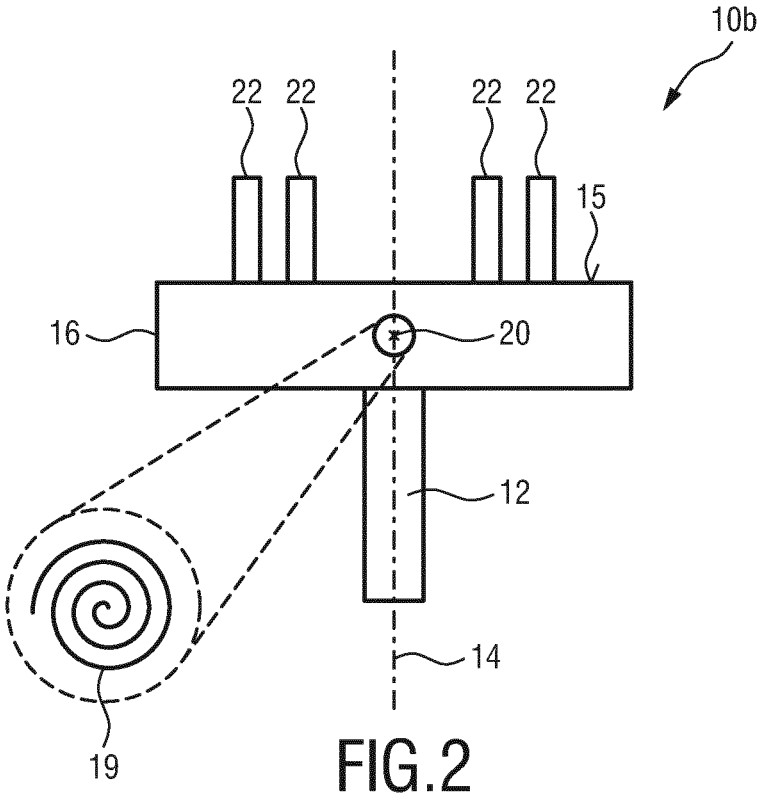
FIG. 2 shows schematically a brush head according to a second embodiment.

FIG. 2 shows schematically a brush head 10*b* according to a second embodiment. The brush head 10*b* of FIG. 2 is similar to that of FIG. 1 but differs by the elastic means. Instead of a longitudinal spring as shown in FIG. 1, the brush head 10*b* utilizes a spiral spring 19 as elastic means. The spiral spring 19 comprises a spirally formed winding about the second axis 20 as schematically shown in the enlarged sketch of FIG. 2. This enables a more compact design for the brush head 10*b*.

Figure 3I:
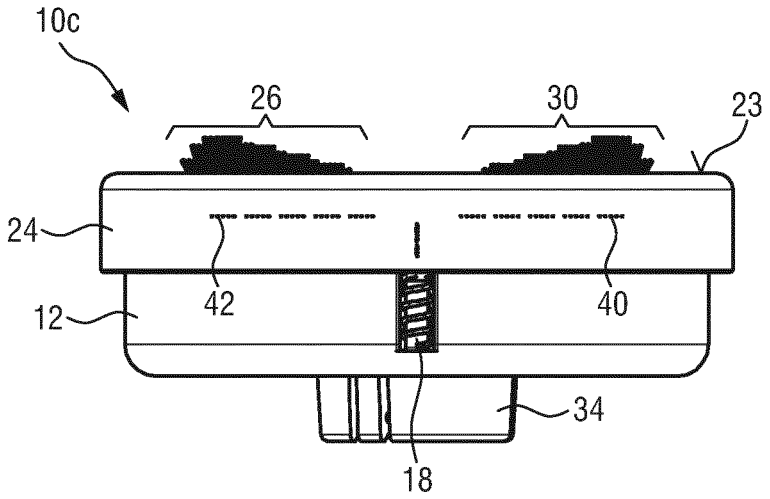
FIG. 3 shows schematically a brush head according to a third embodiment in a side view and in a top view.
Figure 3:
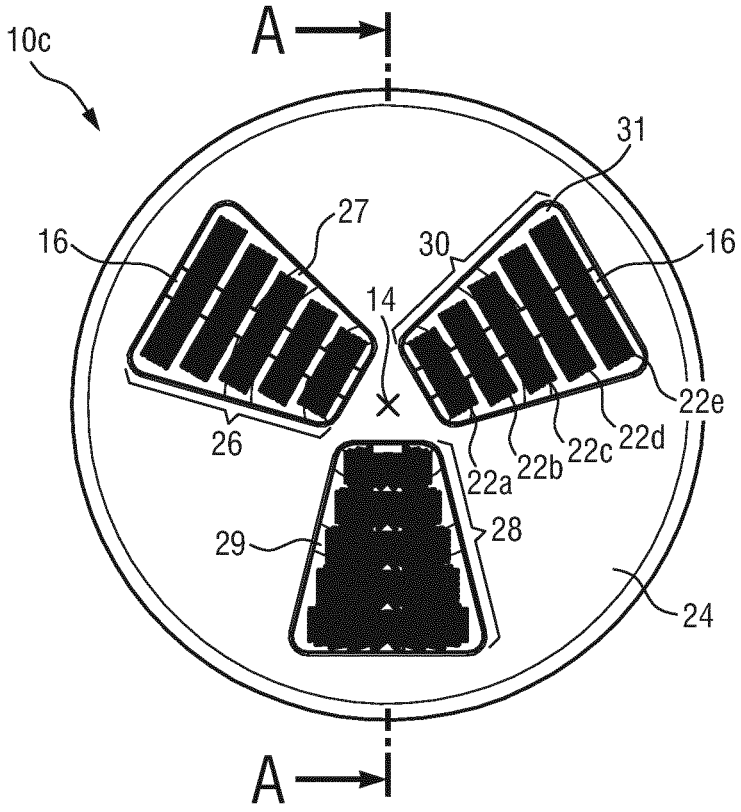

FIG. 3 shows schematically a brush head 10*c* according to a third embodiment in a side view (FIG. 3(I)) and in a top view (FIG. 3(II)).

As shown in the side view of FIG. 3(I), the brush head 10*c* comprises besides the supporting frame 12 also a cover 24 that is attached to the top side of the supporting frame 12. The supporting frame 12 further comprises a connector 34 on the bottom side of the supporting frame 12.

As can be seen in the top view of FIG. 3(II), the bristles 22 are divided into three bristle groups 26, 28, 30. Each bristle group 26, 28, 30 comprises bristles 22*a*-22*e* of five different lengths. The bristles 22*a*-22*e* of each bristle group 26, 28, 30 are fixedly carried by a corresponding carrier part, which is exemplarily shown as a shaft 16. Each of the three shafts 16 extends from a central region surrounding the first axis 14 towards the outer border of the brush head 10*c* in a radial direction. At the outer border, each shaft 16 is connected to the supporting frame 12 by a longitudinal spring 18 that is guided about a vertical guiding rod (shown in FIG. 3(I)). A joint or hinge is provided in the central region of the brush head 10*c* for connecting each shaft 16 to the supporting frame 12 and/or the cover 24 while allowing pivoting of the shaft 16 about the second axis 20 (not shown in FIG. 3) perpendicular to the first axis 14.

The cover 24 comprises three openings 27, 29, 31 for enabling the bristles 22 of each bristle group 26, 28, 30, respectively, to protrude above a top surface 23 of the cover 24. Preferably, the bristles 22 protrude the top surface 23 while the shaft 16 is oriented in a planar direction (i.e. perpendicular to the first axis 14) when there is no external pressing force acting on the brush head 10*c*.

The bristles 22*a*-22*e* are arranged so that their length increases with their radial distance from the central region of the brush head 10*c*. This enables a firtree-like form for the bristle groups 26, 28, 30. Correspondingly, the openings 27, 29, 31 have a width which increases radially outwards, resulting in a trapezoidal opening as seen in the top view of FIG. 3(II). This minimizes the area of the openings 27, 29, 31 so that the contact between the brush head 10*c* and the skin can be established in a safe manner, while still allowing a sufficient contact between the bristles and the skin for effective cleaning and cleansing.

Both the cover 24 and the supporting frame 12 have a circular cross-section. This enables homogeneous force distribution so that the cleaning and cleansing effect using the brush head 10*c* is better controllable over the skin surface.

Figure 4I:
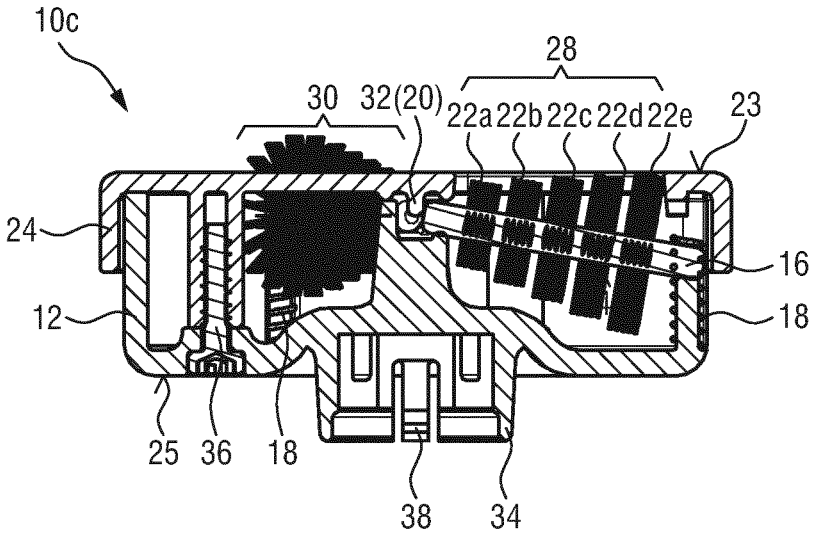
FIG. 4 shows schematically a brush head according to the third embodiment in a cross-sectional view and in another side view.
Figure 4:
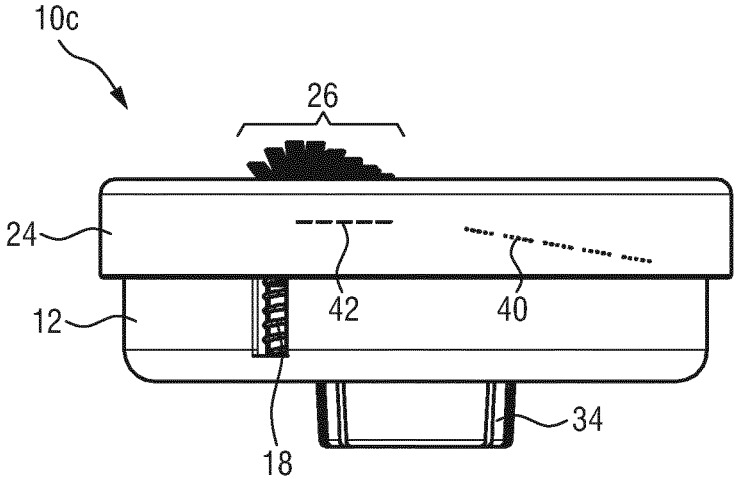

FIG. 4 shows schematically the brush head 10*c* according to the third embodiment in a cross-sectional view of a plane A-A in FIG. 3(II) and in another side view.

As shown in the cross-sectional view of FIG. 4(I), the shaft 16 is connected to the supporting frame 12 and the cover 24 in the central region of the brush head 10*c* via a joint 32 so that the shaft 16 is pivotable about the second axis 20 that is defined by the joint 32. Two bristle groups 28, 30 are visible in FIG. 4(I), wherein a first bristle group 26 is in a state where the bristles 22*a*-22*e* are tilted towards a bottom surface 25 of the supporting frame 12 by pivoting the shaft 16 about the second axis 20. In this state, the spring 18 associated with the first bristle group 28 is compressed with respect to the state where no external force is applied to the first bristle group 28. A second bristle group 30 is in a state where no external force is applied to press the bristles

22*a*-22*e* so that they are not tilted towards the bottom surface 25 and the shaft 16 associated with the second bristle group 30 is not pivoted about the second axis 20. Each bristle group 26, 28, 30 has its own second axis 20 defined by the central joint associated with the respective bristle group 26, 28, 30.

Further, two additional rotation axes 40, 42 are visualized in the side view of FIG. 4(II) as dashed lines. The axes 40, 42 are third axes about which the shafts 16 of the two bristle groups 26, 30 are rotatable. The shafts 16 are preferably cylindrical shafts having a cylinder axis, wherein each third axis 40, 42 corresponds to the cylinder axis of the respective cylindrical shaft 16. Alternatively, at least one of the shafts 16 may have a cross-section perpendicular to its symmetry axis, wherein the cross-section has another form, e.g. triangular, rectangular, pentagonal, hexagonal, octahedral, wherein the symmetry axis is the third axis. Preferably, at least one of the shafts 16 can be driven, e.g. by one or more additional actuators, to rotate about the third axis 40, 42.

For each bristle group 26, 28, 30, the bristles 22*a*-22*e* of each of the different lengths form each a subgroup. In each subgroup, the bristles 22*a*-22*e* are arranged such that they extend from the shaft 16 radially outwards with respect to the third axis 40, 42. Preferably, the subgroups are spatially distanced from each other along the radial direction defined by the shaft 16. The number of the bristles 22*a*-22*e* of each subgroup may be chosen preferably to be any value between 1 and 250.

Preferably, the bristles 22*a*-22*e* of each subgroup are arranged symmetrically with respect to the third axis 40, 42, i.e. the relative rotation angle between two adjacent bristles 22*a*-22*e* is essentially the same for each subgroup. Within each subgroup, the bristle(s) 22*a*-22*e* oriented with the same rotation angle with respect to the third axis 40, 42 forms/form a section.

Further preferably, the number of bristles 22*a*-22*e* as well as the relative rotation angle between two adjacent bristles 22*a*-22*e* in each subgroup are the same for all subgroups. The different subgroups of bristles 22*a*-22*e* differ only in the length of the bristles 22*a*-22*e*. As visible in FIGS. 4(I) & (II), five bristles 22*a*-22*e* which extend in the direction pointing out of the plane of drawing are aligned along the shaft 16. This alignment repeats for all rotation angles of the bristles 22*a*-2*e* with respect to the third axis 40. This improves the controllability of the pressure acting on the skin surface since irregularity regarding arrangement of bristles within one bristle group is diminished.

A screw-thread-connection 36 is provided to fixedly connect the cover 24 to the supporting frame 24. Within the connector 34, a screw is provided 38 for fixation of the brush head 10*c* to a housing of a body care device (not shown).

Figure 5:
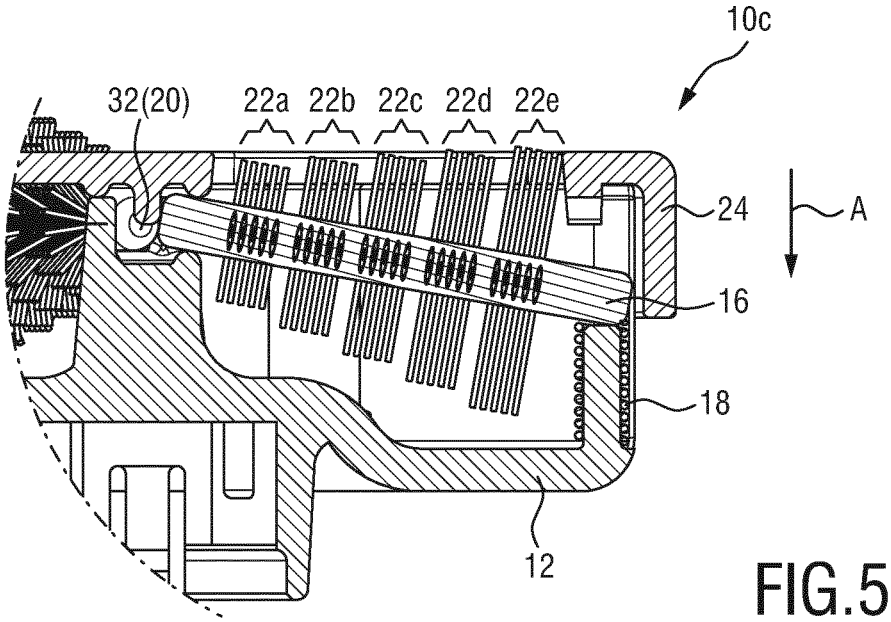
FIG. 5 shows a part of the brush head according to the third embodiment in an enlarged cross-sectional view.

FIG. 5 shows a part of the brush head 10*c* according to the third embodiment in an enlarged cross-sectional view. Here, one bristle group is shown, wherein the associated shaft 16 is pivoted about the second axis 20 of the central joint 32 as indicated by an arrow A. The longitudinal spring 18 is correspondingly compressed. The bristles 22*a*-22*e* of different lengths are tilted so that their ends are aligned essentially to the same height measured in the vertical direction parallel to the first axis 14 (not shown).

The state of use as shown in FIG. 5 can be reached when the brush head 10*c* is pressed against the skin surface. At the beginning, the bristles 22*e* of the largest length and arranged radially outermost first come into contact with the skin surface. As the pressing force is further increased by the user and for the case where the spring constant of the spring 18 is higher than the elasticity constant of the skin surface (i.e. the spring is harder than the skin), the skin surface may be first deformed before compressing the spring 18. This allows the shorter bristles 22*a*-22*d* to also come into contact with the skin surface. At this moment, the skin contacted by the radially outermost bristles 22*e* are deformed more than the skin contacted by the radially inner bristles 22*a*-22*d*, wherein the skin deformation reduces with the radial distance of the bristles 22*a*-22*e* from the central region of the brush head 10*c*. This means the pressure forces exerting onto the skin surface by the bristles 22*a*-22*e* of different lengths (subgroups) are different.

When the user now further presses the brush head 10*c* against the skin surface, the longitudinal spring 18 starts to be compressed so that the alignment shown in FIG. 5 is reached. In this state, the difference in skin deformation at contact spots associated with bristles 22*a*-22*e* of different lengths (subgroups) is reduced and more balanced, resulting in a more homogeneous and better controllable pressure force distribution.

Alternatively, the longitudinal spring 18 may be compressed simultaneously (when the spring 18 and the skin have similar hardness) or prior (when the spring 18 is softer than the skin) to the deformation of the skin surface while increasing the pressing force towards the skin surface after establishing the initial contact between the brush head 10*c* and the skin. In this case, the alignment of the bristles 22*a*-22*e* shown in FIG. 5 is reached more easily, since the shaft 16 can be pivoted about the second axis 20 more easily.

Figure 6:
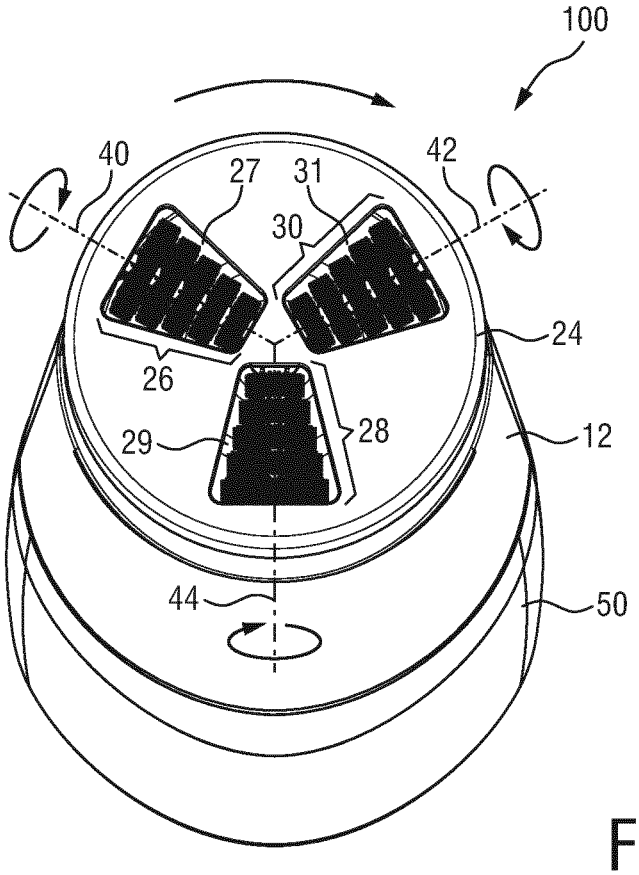
FIG. 6 shows a body care device in a perspective view.

FIG. 6 shows a body care device 100 in a perspective view. The body care device 100 comprises a brush head 10, e.g. according to the third embodiment. The three rotation axes (third axes) 40, 42, 44 are visible and intersect at a center 11 of the brush head 10 which the first axis 14 (not shown) goes through. The body care device 100 further comprises a housing 50, on which the brush head 10 is mounted.

Figure 7:
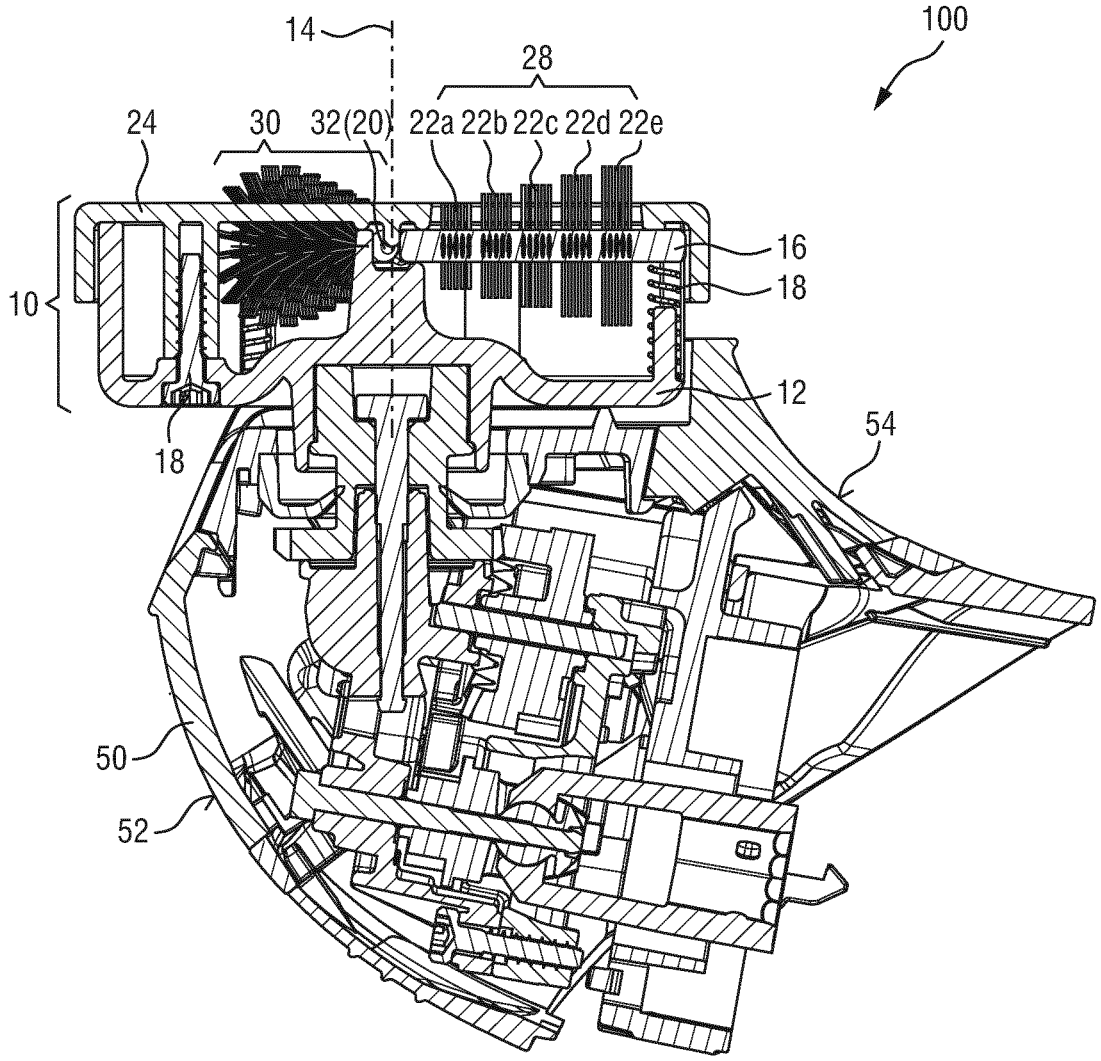
FIG. 7 shows the body care device of FIG. 6 in a cross-sectional view.

The body care device 100 is shown in more detail in FIG. 7 in a cross-sectional view. As can be seen in FIG. 7, the same brush head 10 as shown in the embodiment of FIG. 3-4 is mounted on the housing 50. Therefore, the details regarding the brush head 10 is omitted.

The housing 50 is preferably configured to accommodate an actuator for driving the brush head 10 to rotate about the first axis 14. Further preferably, the housing 50 is configured to accommodate a power source (e.g. a battery) or a wiring for connecting to an external power source. The housing 50 has preferably a convex contour on a first lateral side 52 and a concave contour on a second lateral side 54 opposite to the first lateral side 52. This enables an ergonomically improved design which facilitates holding of the body care device 100 with the bear hand and thus better controlling of the cleaning and cleansing using the brush head 10.

The term "rotation angle" with respect to a specific axis is understood as being measured from a predefined starting plane in which that specific axis lies, wherein the rotation angle associated with the predefined starting plane has the value zero.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A brush head for use with a body care device, comprising a plurality of bristles, a carrier for fixedly carrying the plurality of bristles, and connection means for connecting the carrier to a housing of the body care device defining a first axis, so that, when the brush head is connected to the housing, the carrier is rotatable about the first axis and pivotable about a second axis perpendicular to the first axis with respect to the housing, wherein the carrier comprises a plurality of carrier parts, each fixedly carrying a corresponding one of a plurality of bristle groups, and wherein at least one of the plurality of carrier parts comprises a shaft defining a third axis, about which the corresponding bristle group is rotatable.

2. The brush head according to claim 1, wherein the connection means comprise a supporting frame for connecting the carrier to the housing of the body care device.

3. The brush head according to claim 2, wherein the supporting frame is drivable by an actuator of the housing of the body care device to rotate about the first axis, and/or wherein the carrier is pivotable about the second axis with respect to the supporting frame.

4. The brush head according to claim 2, wherein at least one of the plurality of carrier parts is connected to the supporting frame in a central region of the supporting frame.

5. The brush head according to claim 4, wherein elastic means are provided so that at least one of the plurality of carrier parts is elastically pivotable with respect to the supporting frame.

6. The brush head according to claim 5, wherein the elastic means comprise a longitudinal spring arranged to be radially distant from the central region.

7. The brush head according to claim 5, wherein the elastic means comprise a spiral spring with a spirally formed winding about the second axis.

8. The brush head according to claim 1, wherein the third axis is perpendicular to the second axis.

9. The brush head according to claim 1, wherein the bristles of at least one of the bristle groups form two or more subgroups each containing at least one bristle, wherein the bristles of different subgroups have different lengths.

10. The brush head according to claim 9, wherein the two or more subgroups are spatially separated from each other along a radial direction with respect to the first axis.

11. The brush head according to claim 1, wherein at least two of the plurality of bristles differ in length.

12. The brush head according to claim 11, wherein the length of the bristles increases with a radial distance of the respective bristle from a central region of the brush head.

13. The brush head according to claim 1, further comprising a cover attached to a top side of the carrier, the cover comprising at least one opening.

14. The brush head according to claim 13, wherein the at least one opening has a width that increases from a central region towards an outer border of the cover.

15. A body care device, comprising:

a brush head as claimed in claim 1; and a housing to which the brush head is connected, the housing being configured to accommodate an actuator for driving the brush head to rotate with respect to the housing.

* * * * *